US008091974B2

(12) United States Patent
Ino et al.

(10) Patent No.: US 8,091,974 B2
(45) Date of Patent: Jan. 10, 2012

(54) COLORING MATERIAL RECORDING DEVICE, COLORING MATERIAL RECORDING PROGRAM, AND IMAGE FORMING APPARATUS

(75) Inventors: Naosuke Ino, Kanagawa (JP); Tohru Shimizu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 440 days.

(21) Appl. No.: 12/275,307

(22) Filed: Nov. 21, 2008

(65) Prior Publication Data

US 2009/0189928 A1 Jul. 30, 2009

(30) Foreign Application Priority Data

Jan. 25, 2008 (JP) ..... 2008-015578

(51) Int. Cl.
*B41J 29/38* (2006.01)

(52) U.S. Cl. ..... 347/9; 347/15; 347/19

(58) Field of Classification Search ..... 347/5, 9, 347/14, 15, 19; 346/46
See application file for complete search history.

(56) References Cited

U.S. PATENT DOCUMENTS

| | | | | |
|---|---|---|---|---|
| 4,675,696 | A * | 6/1987 | Suzuki | 346/46 |
| 5,596,353 | A * | 1/1997 | Takada et al. | 347/19 |
| 6,412,902 | B2 | 7/2002 | Matsumoto et al. | |
| 6,595,612 | B1 * | 7/2003 | Brown et al. | 347/9 |
| 6,905,186 | B2 | 6/2005 | Kojima | |
| 2006/0146082 | A1 * | 7/2006 | Nunokawa et al. | 347/15 |

FOREIGN PATENT DOCUMENTS

| | | |
|---|---|---|
| JP | 03-246060 | 11/1991 |
| JP | 09-066650 | 3/1997 |
| JP | 2000-158640 | 6/2000 |
| JP | 2002-79663 | 3/2002 |
| JP | 2004-122759 | 4/2004 |
| JP | 2004-195862 | 7/2004 |

* cited by examiner

*Primary Examiner* — Lam S Nguyen
(74) *Attorney, Agent, or Firm* — Fildes & Outland, P.C.

(57) ABSTRACT

A coloring material recording device comprises a plurality of image recording elements and a control unit. The plurality of image recording elements record with a plurality of coloring materials on a recording medium and form an image, and one of the plurality of image recording elements is provided for each of the coloring materials. The control unit controls the plurality of image recording elements such that detection images of at least two coloring materials of the plurality of coloring materials overlap each other on the recording medium.

6 Claims, 14 Drawing Sheets

| | EJECTING CONDITION | |
|---|---|---|
| | M | Y |
| (a) | ○ | ○ |
| (b) | ○ | × |
| (c) | × | ○ |
| (d) | × | × |

| | EJECTING CONDITION | |
|---|---|---|
| | M | Y |
| (a) | ○ | ○ |
| (b) | ○ | × |
| (c) | × | ○ |
| (d) | × | × |

FIG. 13A

| | $\sigma$ | HEAD INFORMATION (1-BIT) |
|---|---|---|
| GRADE 1 | $\sigma \leqq 2$ ($\mu m^2$) | 0 |
| GRADE 2 | $2 < \sigma \leqq 5$ ($\mu m^2$) | 1 |

FIG. 13B

| | HEAD INFORMATION (1-BIT) |
|---|---|
| 1200DPI | 0 |
| 600DPI | 1 |

COLORING MATERIAL RECORDING DEVICE, COLORING MATERIAL RECORDING PROGRAM, AND IMAGE FORMING APPARATUS

CROSS-REFERENCE TO RELATED APPLICATION

This application is based on and claims priority under 35 USC 119 from Japanese Patent Application No. 2008-015578 filed Jan. 25, 2008.

BACKGROUND

1. Technical Field

The present invention relates to a coloring material recording device, a coloring material recording program, and an image forming apparatus.

2. Related Art

Image forming apparatuses are known that are provided with liquid ejecting devices for forming images on a recording medium by ejecting plural inks, such as C, M, Y, K, from recording heads provided with ejection elements (nozzles). If problems such as poor ejection occur in the operation of such nozzles, then poor images are generated, such as images with uneven streaky color effects, uneven density. There are therefore various techniques described for detecting the ejecting condition of the nozzles.

SUMMARY

According to an aspect of the invention, there is provided a coloring material recording device includes a plurality of image recording elements that record with a plurality of coloring materials on a recording medium and form an image, at least one of the plurality of image recording elements provided for each of the coloring materials, and a control unit that controls the plurality of image recording elements such that detection images of at least two coloring materials of the plurality of coloring materials overlap each other on the recording medium.

BRIEF DESCRIPTION OF THE DRAWINGS

Exemplary embodiments of the present invention will be described in detail based on the following figures, wherein:

FIGS. 13A and 13B are explanatory diagrams for explaining a specific example of head information of the second exemplary embodiment.

DETAILED DESCRIPTION

First Exemplary Embodiment

Explanation will now be given of details of an exemplary embodiment of the present invention, with reference to FIG. 1 to FIG. 11. The present exemplary embodiment is an image forming apparatus that forms images with a recording unit by ejecting inks, as coloring material, and treatment liquid from nozzles onto a recording medium, and that prints detection images for each color of ink so as to overlap each other.

Figure 1:
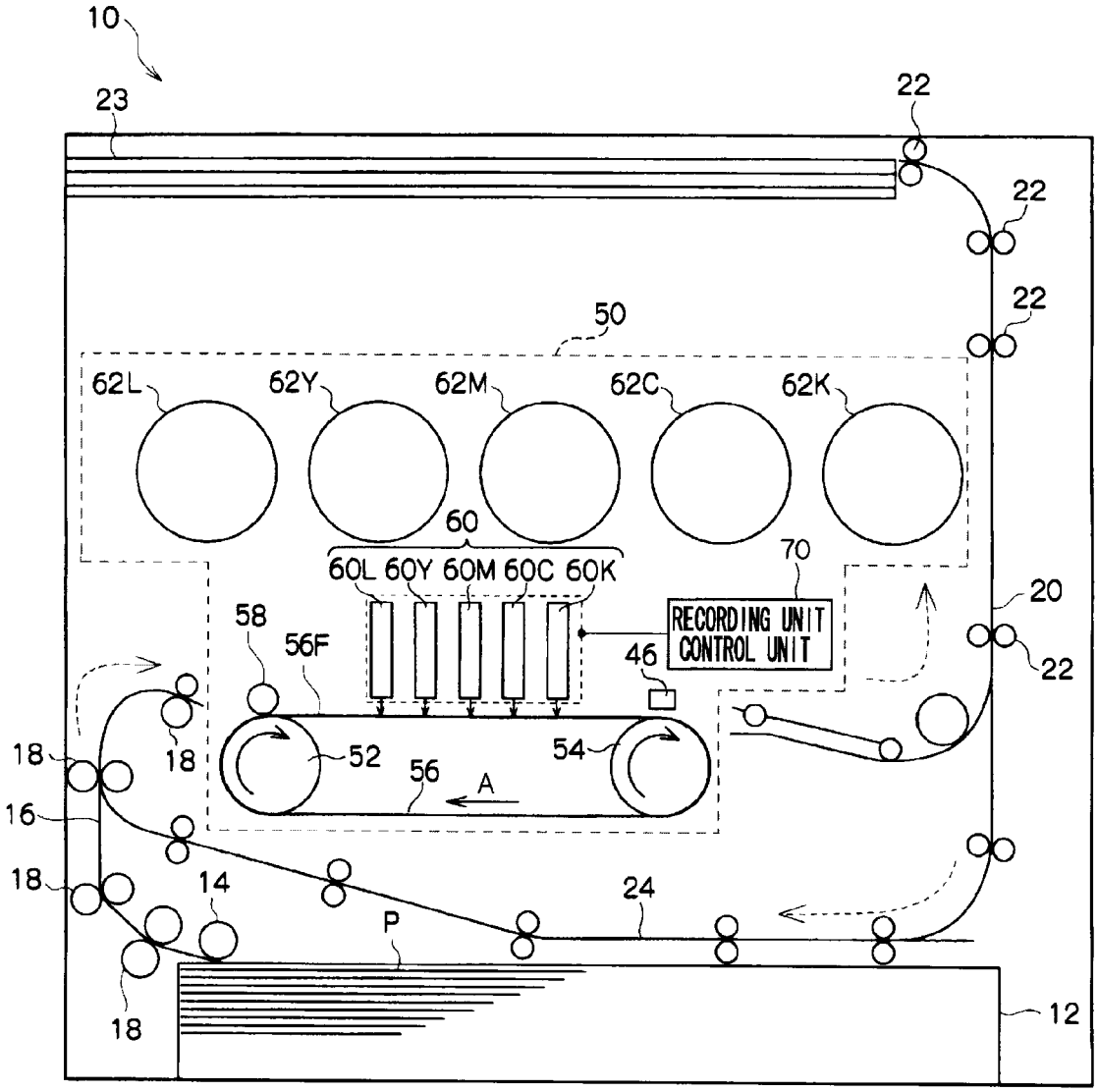
FIG. 1 is a configuration diagram showing an example of a schematic configuration of an image forming apparatus according to a first exemplary embodiment.

FIG. 1 is a configuration diagram showing an example of a schematic configuration of an image forming apparatus 10 of the present exemplary embodiment.

The image forming apparatus 10 of the present exemplary embodiment is configured to include a paper cassette 12, a feed-roll 14, a first conveying path 16, first conveying path roll pairs 18, a second conveying path 20, second conveying path roll pairs 22, a discharge tray 23, a reverse conveying path 24, and a recording unit 50.

The paper cassette 12 stores recording medium P. In the present exemplary embodiment, continuous paper is employed as a specific example of recording medium P. The feed-roll 14 is disposed above the leading edge side of the paper cassette 12 (the left edge side in FIG. 1), and the feed-roll 14 presses on the top face leading edge side of the recording medium P and feeds the recording medium P out from within the paper cassette 12.

The first conveying path 16 is provided for conveying the recording medium P from the paper cassette 12 to the recording unit 50 where images are recorded on the recording medium P. Plural first conveying path rolls pairs 18 are provided for nipping the recording medium P and conveying the recording medium P to the recording unit 50.

The discharge tray 23 accommodates recording medium P that has been recorded with images, and the second conveying path 20 is provided for conveying the recording medium P from the recording unit 50 to the discharge tray 23. Plural second conveying path roll pairs 22 are provided along the second conveying path 20. In the image forming apparatus 10 of the present exemplary embodiment a reverse conveying path 24 is provided for carrying out double sided printing, the reverse conveying path 24 connecting from the second conveying path 20 to the first conveying path 16.

With the above configuration recording medium P that has been fed out from the paper cassette 12 by the feed-roll 14 is conveyed by the plural first conveying path roll pairs 18 along the first conveying path 16, and fed into the recording unit 50 where image recording is carried out. The recording medium P to which images have been recorded is conveyed along the second conveying path 20 by plural second conveying path roll pairs 22, and discharged into the discharge tray 23. However, when double sided printing is carried out the recording medium P that has been printed on one side is conveyed from the second conveying path 20 to the first conveying path 16 via the reverse conveying path 24, and fed back into the recording unit 50 where image recording is carried out.

The recording unit 50 is configured with a drive roll 52, a driven roll 54, a conveying belt 56, a nip roll 58, a recording head 60, an ink tank 62, and a recording unit control unit 70.

The conveying belt 56 is entrained around the drive roll 52 disposed at the upstream side in the paper conveying direction and the driven roll 54 disposed at the downstream side in the paper conveying direction. The conveying belt 56 is driven so as to circulate (rotate) in the direction of arrow A in FIG. 1 (clockwise direction). The nip roll 58 is disposed at an upper portion of the drive roll 52.

The recording head 60 is disposed above the conveying belt 56, and, as an example in the present exemplary embodiment, the length dimension of the recording head 60 is same as or greater than the width (length in the direction orthogonal to the conveying direction) of the effective recording region on the recording medium P. The recording head 60 is provided with: a treatment liquid head 60L, for ejecting treatment liquid to promote ink adhesion and to increase the density and water resistance of images; and four ink heads 60Y, 60M, 60C, and 60K, for ejecting inks of four colors, respectively yellow (Y), magenta (M), cyan (C), and black (K). The treatment liquid head 60L and the ink heads 60Y, 60M, 60C, and 60K are disposed at intervals along the conveying direction and enable full color images to be recorded.

Figure 2A:
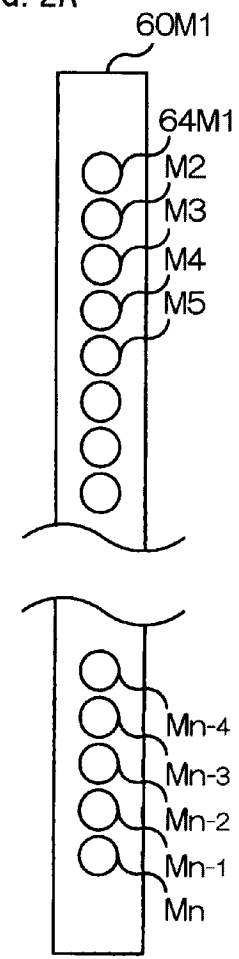
FIG. 2A to 2C are explanatory diagrams for explaining specific examples of a recording head according to the first exemplary embodiment.
Figure 2B:
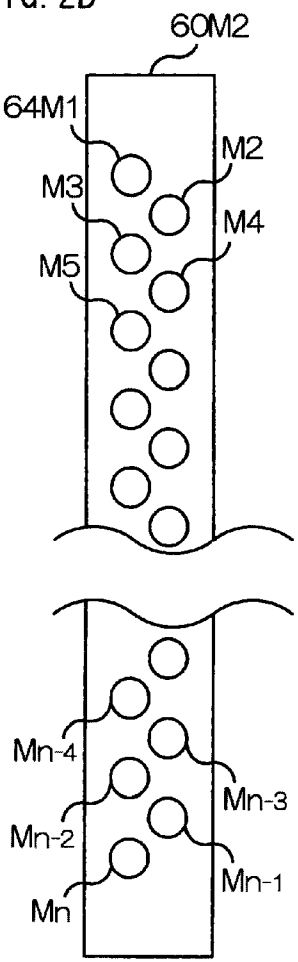
Figure 2C:
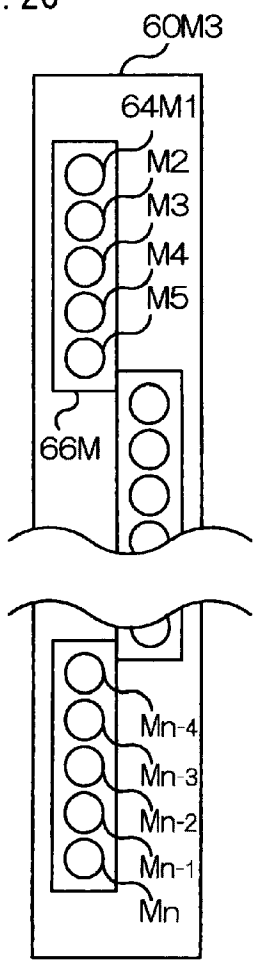

Explanation will now be given of a specific example of the recording head 60, with reference to FIGS. 2A, 2B, 2C. In FIGS. 2A, 2B, 2C examples are given in which the ink heads 60M is used as the representative recording head 60.

The recording head 60 in the present exemplary embodiment is configured with n individual ink ejection apertures (nozzles) 64. In the recording head 60M1 shown in FIG. 2A there are nozzles 64M1 to 64Mn disposed in a row. In the recording head 60M2 shown in FIG. 2B there are nozzles 64M1 to 64Mn disposed in a two-dimensional array, in an alternately staggered pattern. In addition, in the recording head 60M3 shown in FIG. 2C, there are short recording heads (modules) 66M disposed in an alternately staggered two-dimensional array, with the modules 66M each including 5 individual nozzles 64M. When such a configuration is made the number of nozzles 64M included in the modules 66M are not limited to this number and other numbers of individual nozzles 64M may also be employed, the arrangement is also not limited to this arrangement, and an alternately staggered two-dimensional array may also be employed. The arrangement between the modules 66M themselves is also not limited to the above arrangement and other arrangements thereof may be made.

Plural of the recording heads 60 may be provided for each of the colors C, M, Y, and K and for each treatment liquid L. Configuration may also be made with respective nozzles 64C, 64M, 64Y, and 64K, for ejecting inks of each color C, M, Y, and K, provided in a single recording head 60.

The recording head 60 faces a flat section 56F of the conveying belt 56, and this facing region is the ejection region in which ink droplets and treatment liquid is ejected from the recording head 60. The recording medium P conveyed along the first conveying path 16, is held on the conveying belt 56, and reaches this ejection region. Ink droplets and treatment liquid is adhered from the recording head 60 to the recording medium P, according to image information, in a state in which the recording medium P faces the recording head 60.

Ink tanks 62Y, 62M, 62C, and 62K are disposed above ink heads 60Y, 60M, 60C, and 60K for supplying each of the respective inks thereto, and a treatment liquid tank 62L is disposed above the treatment liquid head 60L for supplying treatment liquid thereto.

Each of the ink heads 60Y, 60M, 60C, and 60K and the treatment liquid head 60L is connected to the recording unit control unit 70. The recording unit control unit 70, for example, determines according to image information the ejection timing of the ink droplets and treatment liquid and the nozzles 64 to be used, in order to form images on the recording medium P according to the image information, and inputs a drive signal to the ink heads 60Y, 60M, 60C, and 60K and the treatment liquid head 60L, controlling the recording head 60. The recording unit control unit 70 also performs control related to later described detection of the ejecting condition of the nozzles 64.

Figure 3:
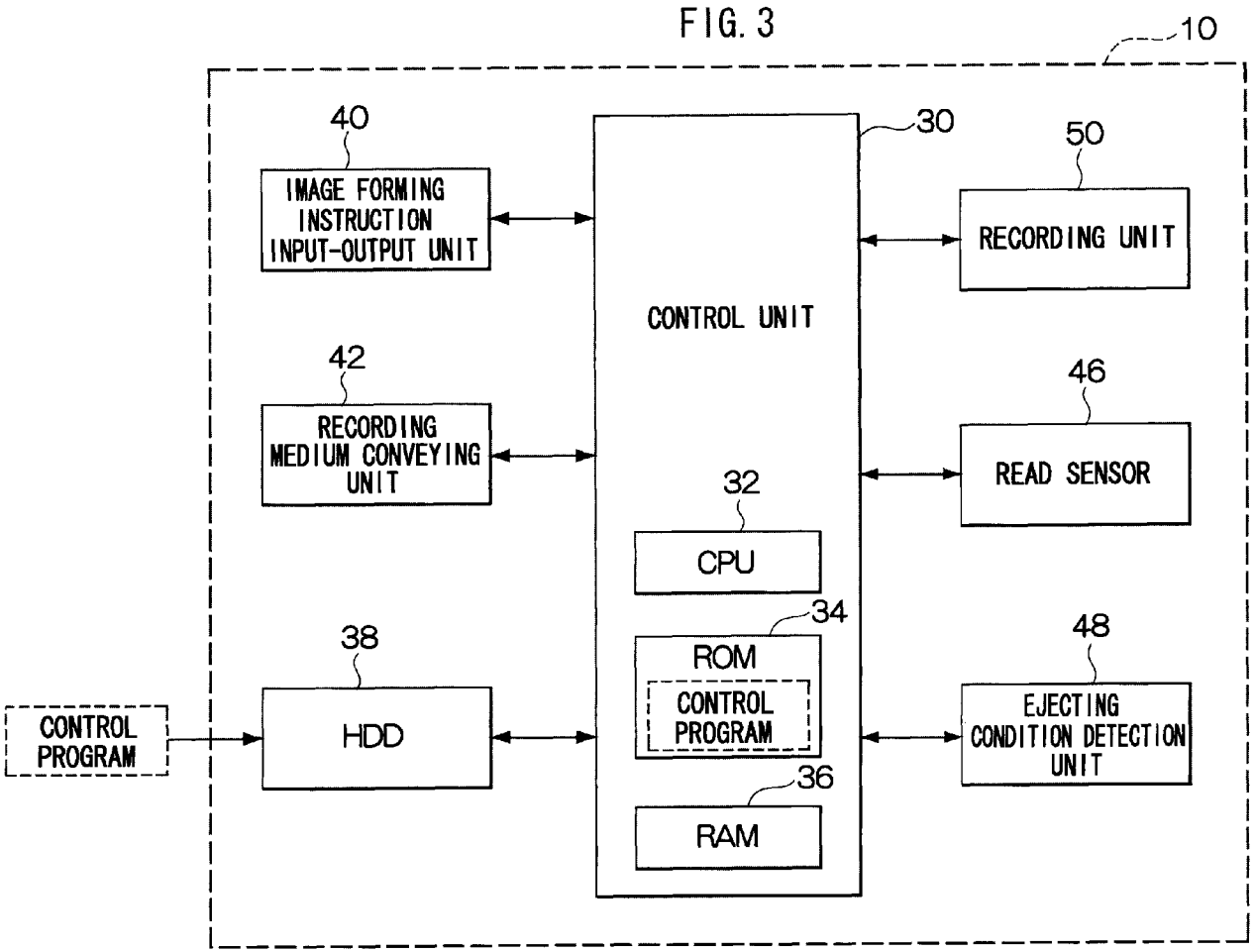
FIG. 3 is a functional block diagram showing an example of a schematic configuration of an image forming apparatus of the first exemplary embodiment.

A functional block diagram showing an example of a schematic configuration of the image forming apparatus 10 of the present exemplary embodiment is next shown in FIG. 3.

The image forming apparatus 10 of the present exemplary embodiment is configured with a control unit 30, a HDD 38, an image forming instruction input-output unit 40, a recording medium conveying unit 42, a read sensor 46, and an ejecting condition detection unit 48.

The control unit 30 controls the image forming apparatus 10 overall, and performs the control relating to ejecting condition detection of the present exemplary embodiment (described in detail later). The control unit 30 is configured to include a CPU 32, ROM 34 and RAM 36. A later described control program relating to ejecting condition detection, and various programs and parameters etc. are stored in the ROM 34. The RAM 36 is employed as a work area and the like when various programs are executed by the CPU 32.

The various programs, such as the later described control program related to ejecting condition detection, may be stored on storage media (not shown in the figures) such as a DVD-ROM, CD-ROM, etc., on a removable device (not shown in the figures), or installed on the HDD 38 or the like, such that the programs read in by the CPU 32 and executed.

The image forming instruction input-output unit 40 inputs instructions, such as instructions input such as by a user relating to image forming, image data and instructions relating to ejecting condition detection, and outputs such to a user information relating to image forming and information relating to ejecting condition detection. Specific examples of the image forming instruction input-output unit 40 include user interfaces such as a display and mouse, keyboard etc.

The recording medium conveying unit 42 conveys the recording medium P by driving the feed-roll 14, first conveying path 16, first conveying path roll pairs 18, second conveying path 20, second conveying path roll pairs 22, etc.

The read sensor 46 is for reading in detection images (described in detail later) and a specific example thereof includes an optical sensor. The ejecting condition detection unit 48 (described in detail later) is for detecting the ejecting condition of the nozzles 64 based on the results of the detection images read-in by the read sensor 48.

Figure 4:
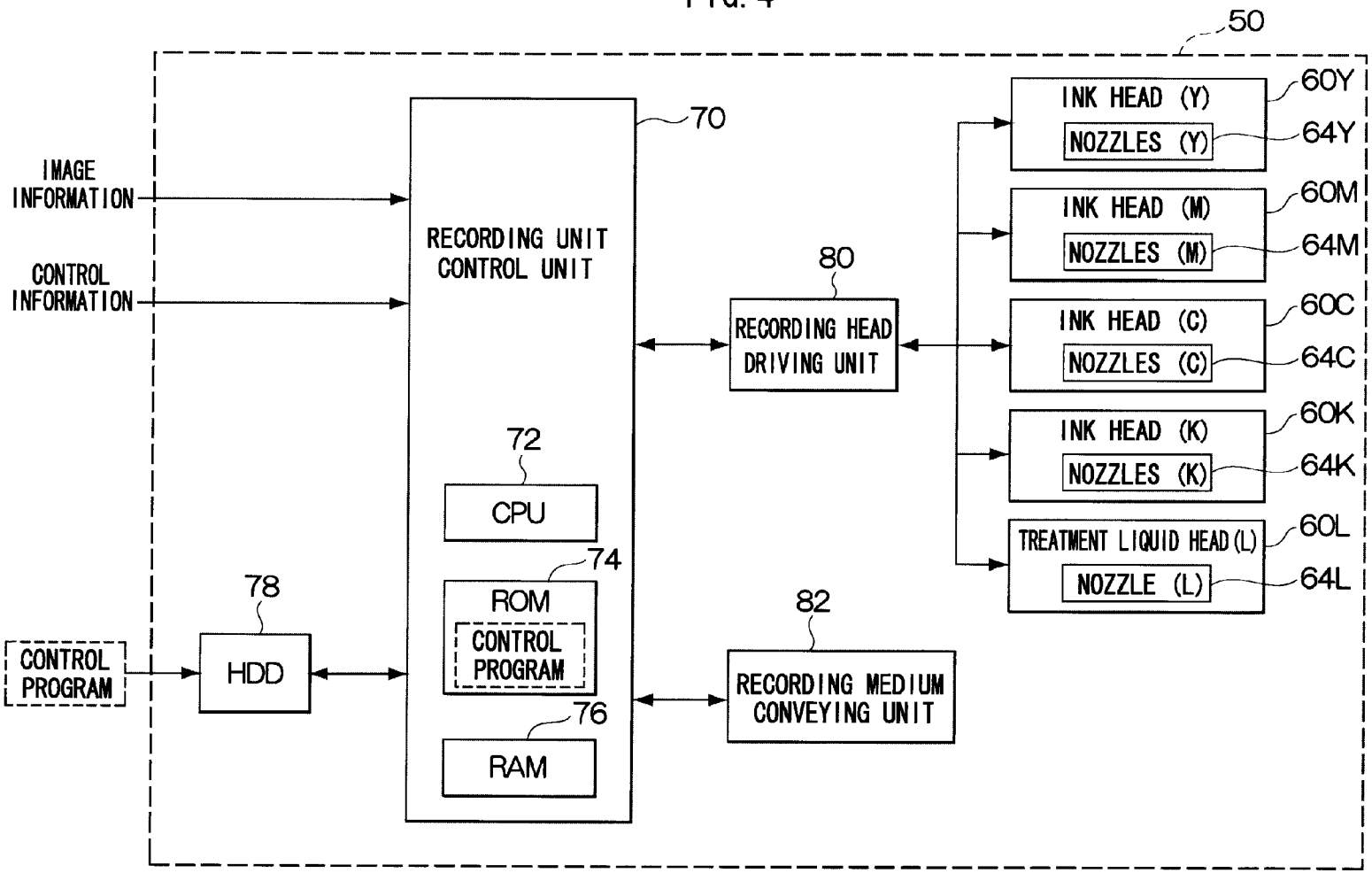
FIG. 4 is a functional block diagram showing an example of a schematic configuration of a recording unit of the first exemplary embodiment.

A functional block diagram of an example of a schematic configuration of the recording unit 50 of the present exemplary embodiment is shown in FIG. 4.

The recording unit 50 of the present exemplary embodiment is configured including the recording unit control unit 70, a HDD 78, a recording head driving unit 80, a recording medium conveying unit 82, the ink heads 60Y, 60M, 60C, and 60K, and the treatment liquid head 60L.

The recording unit control unit 70 controls the recording unit 50 overall, and performs control relating to printing of detection images (nozzle-check patterns) in the present exemplary embodiment. The recording unit control unit 70 is configured including a CPU 72, ROM 74, and RAM 76. Various programs, such as the later described control program relating to ejecting condition detection, parameters, etc. are stored on the ROM 74. The RAM 76 is employed as a work area etc. when the CPU 72 executes the various programs.

The various programs, such as the later described control program related to nozzle-check pattern printing, may be stored on storage media (not shown in the figures) such as a DVD-ROM, CD-ROM, etc., on a removable device (not shown in the figures), or installed on the HDD 78 or the like, such that the programs are read in by the CPU 72 and executed.

The HDD 78 stores preliminary image data for detection images.

The recording head driving unit 80 is for driving the ink heads 60Y, 60M, 60C, and 60K and the treatment liquid head 60L, ejecting ink from the nozzles 64 included in each of the respective recording heads 60, and supplying ink with the ink tank 62.

The recording medium conveying unit 82 is for conveying the recording medium P by driving the drive roll 52, the driven roll 54, the conveying belt 56, the nip roll 58 etc.

Explanation will now be given of details of the ejecting condition detection processing executed by the control unit 30 of the image forming apparatus 10 of the present exemplary embodiment, with reference to FIG. 5 to FIG. 11.

Figure 5:
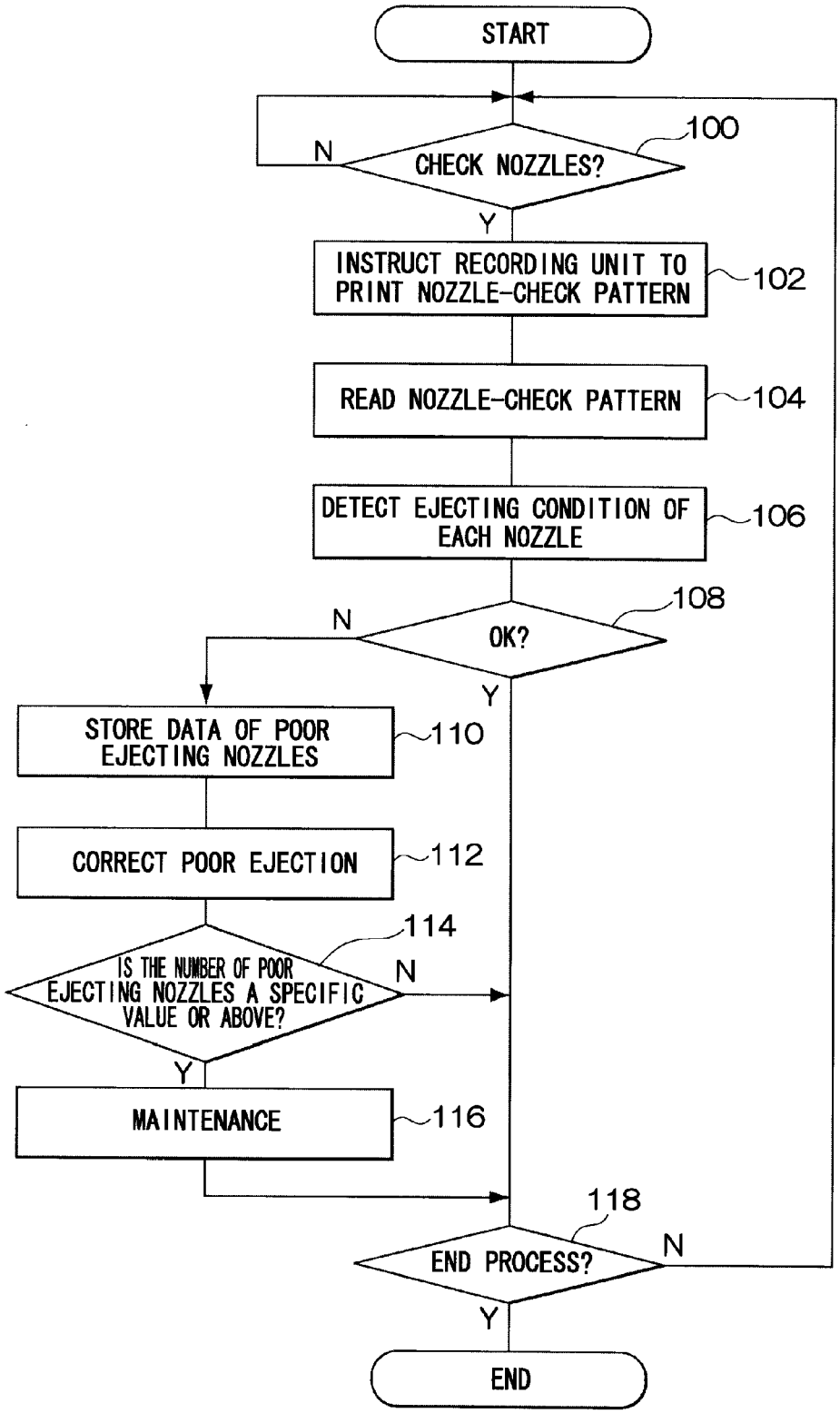
FIG. 5 is a flow chart showing an example of a control routine for ejecting condition detection processing execution by a control unit of an image forming apparatus of the first exemplary embodiment.

A flow chart showing an example of a control routine of the ejecting condition detection processing executed by the control unit 30 of the image forming apparatus 10 is shown in FIG. 5. The ejecting condition detection processing shown in FIG. 5 is, for example, executed when a print instruction, or processing instruction at power on or the like has been input to the control unit 30.

First at step 100, determination is made as to whether or not nozzle-checking (ejecting condition detection) is to be carried out. In the present exemplary embodiment nozzle-checking is determined to be carried out, as an example, when instruction has been input by a user through the image forming instruction input-output unit 40, when image forming has been carried out for a specific number of sheets, and such occasions, however, there is no limitation to these occasions. Determination is negative when nozzle-checking is not to be carried out and the apparatus adopts a standby state. However, when nozzle-checking is to be carried out the routine proceeds to step 102.

At step 102 instruction is given to the recording unit 50 to print a nozzle-check pattern. Note that when there is control information (described in detail later) relating to the printing of the nozzle-check pattern then this control information is output with the print instruction to the recording unit 50.

Explanation will now be given regarding the nozzle-check pattern (detection image) print processing executed in the recording unit control unit 70 of the recording unit 50 in the present exemplary embodiment, with reference to FIG. 6 to FIG. 9.

Figure 7A:
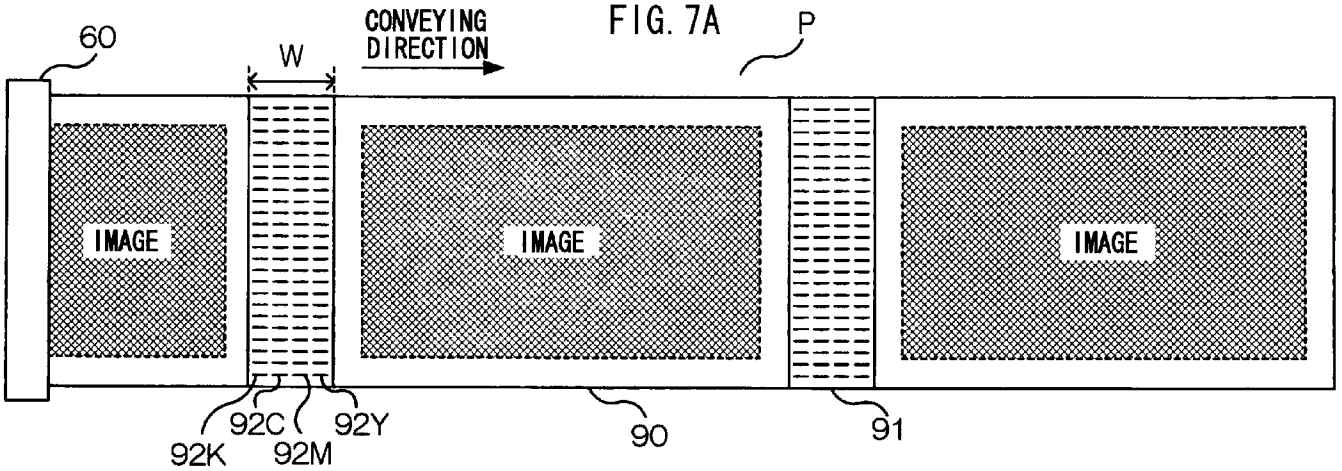
FIGS. 7A and 7B are explanatory diagrams for explaining nozzle-check patterns.
Figure 7B:
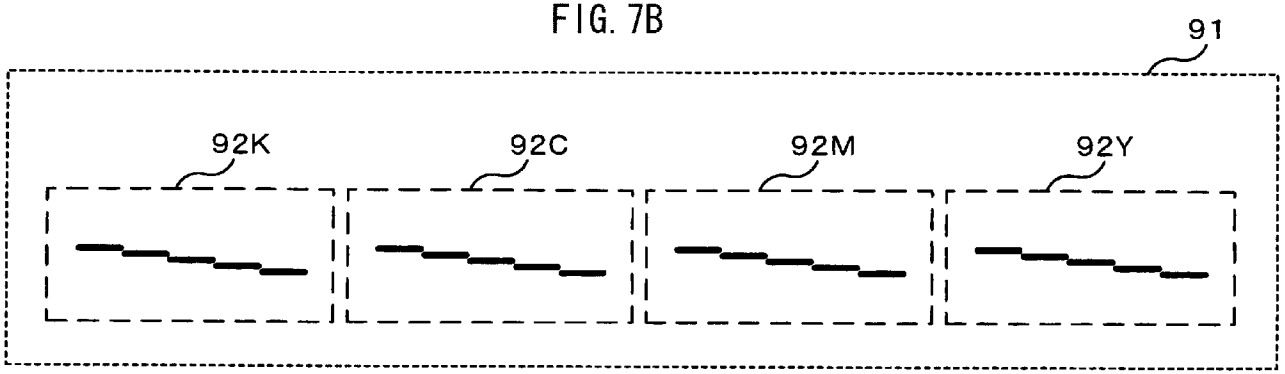

Explanation will first be given regarding the nozzle-check pattern, with reference to FIGS. 7A and 7B and FIGS. 8A and 8B. FIG. 7A shows a printed state of nozzle-check patterns 92Y, 92M, 92C, 92K on the continuous paper recording medium P. The nozzle-check patterns 92Y, 92M, 92C, 92K are printed between one image region 90 and another image region 90 formed with images instructed for image forming by a user, a specific example thereof being printing in a non-image region 91 provided between each page. The size (width W) of the non-image region 91 is determined based on the size of the nozzle-check patterns 92Y, 92M, 92C, 92K. FIG. 7B is a diagram showing an expanded view of a portion of the non-image region 91.

Figure 8B:
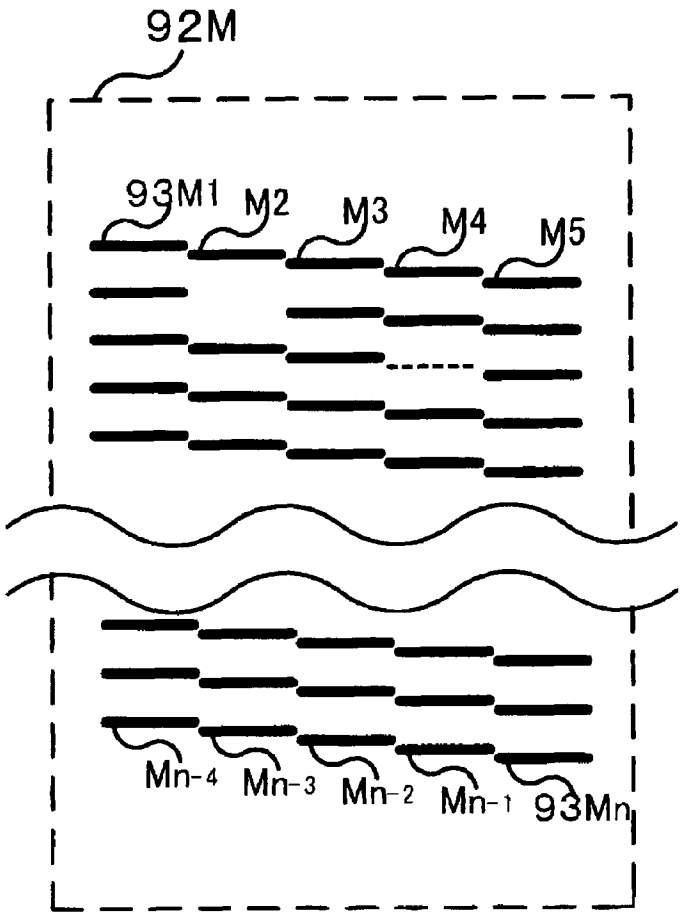
FIGS. 8A and 8B are explanatory diagrams for explaining specific examples of a nozzle-check pattern.
Figure 8A:
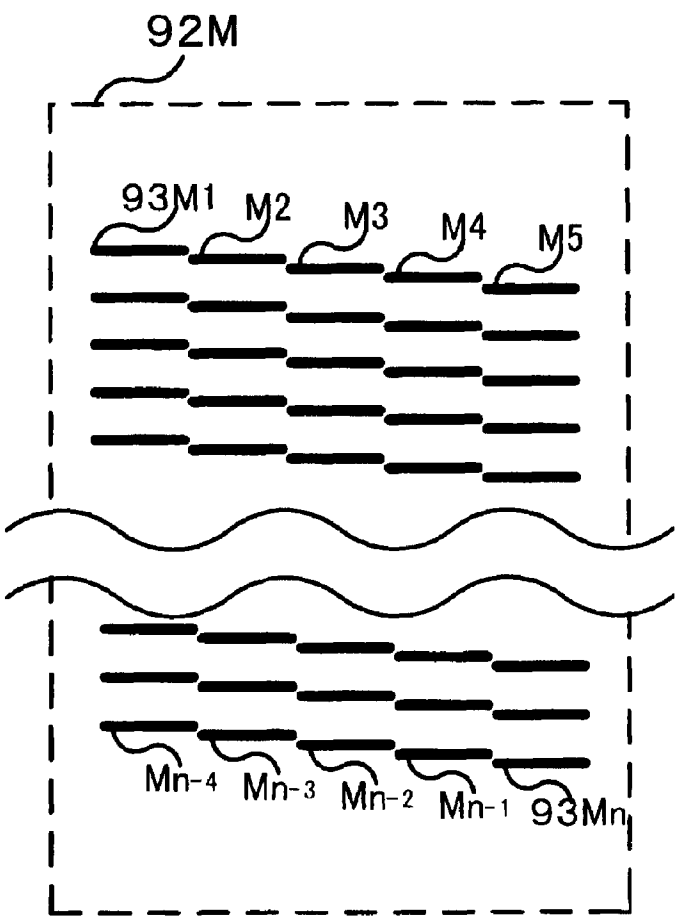

FIG. 8A shows a specific example of a nozzle-check pattern 92M of the present exemplary embodiment. Explanation will only be given here regarding the nozzle-check pattern 92M, however the nozzle-check patterns 92Y, 92C, 92K are similar. The nozzle-check pattern 92M is specific length of lines 93M1 to 93Mn printed from respective nozzles from the n individual nozzles 64M provided to the ink head 60M. Line 93M1 corresponds to nozzle 64M1, line 93M2 corresponds to nozzle 64M2 and line 93Mn corresponds to nozzle 64Mn. It should be noted that while the configuration here is such that the specific length of lines 93M1 to 93Mn are printed there is no limitation thereto, and, for example configuration may be made such that dots or the like are printed without particular limitation as long as the printed image from each of the nozzles 64M is detectable. The length and other features of the lines 93M may be determined in consideration of the read (spot) region of the read sensor 46 and specification thereof.

FIG. 8B shows the nozzle-check pattern 92M in a case where poor ejection is occurring from the nozzles 64M. There is no printing (the missing portion) or thin spots and uneven density (dotted line portion) occurs for the lines 93M corresponding to nozzles 64M that are in a poor ejecting condition.

Figure 6:
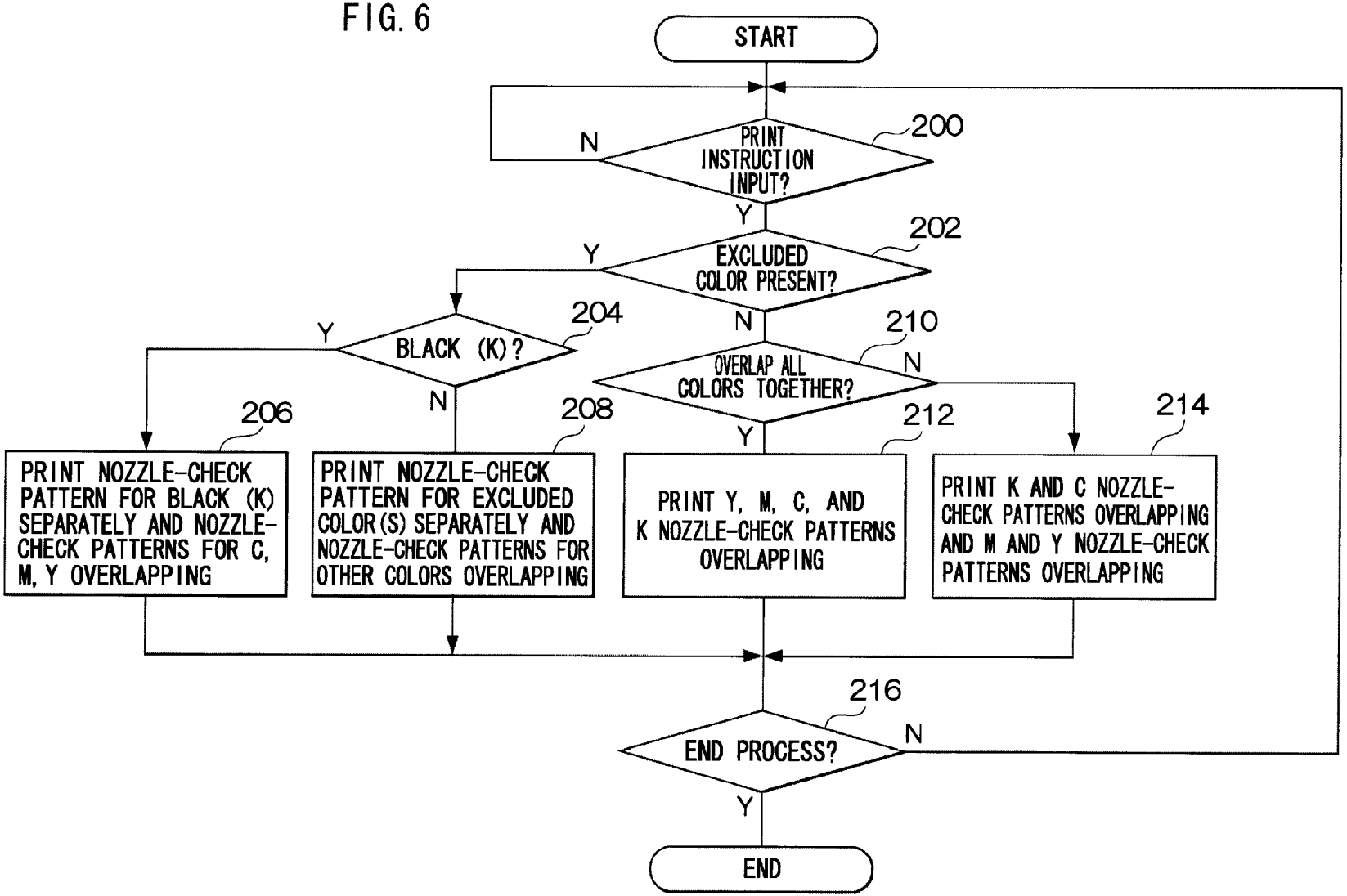
FIG. 6 is a flow chart showing an example of a control routine for nozzle-check pattern print processing executed in a recording unit control unit of a recording unit of the first exemplary embodiment.

Explanation will now be given of details regarding an example of a control routine for nozzle-check pattern print processing, with reference to FIG. 6. FIG. 6 is a flow chart showing an example of a control routine for nozzle-check pattern print processing executed by the recording unit control unit 70 of the recording unit 50. The nozzle-check pattern print processing shown in FIG. 6 is executed, for example, when an instruction has been input to the recording unit control unit 70 from the control unit 30 when carrying out image forming.

First at step 200 determination is made as to whether or not a print instruction for the nozzle-check patterns 92 has been input. Determination is negative until a print instruction has been input from the control unit 30, and a standby state is adopted. However, when it is determined that a print instruction has been input the routine proceeds to step 202. It should be noted that in the present exemplary embodiment, when control information exists relating to the nozzle-check pattern 92 print then this is input with the print instruction. Control information relating to the nozzle-check pattern 92 print is, for example, information such as the colors of nozzle-check patterns 92 to be overlapped, and in the present exemplary embodiment this control information is specifically information representing whether any of the later described steps 206, 208, 212, or 214 are to be carried out.

At step 202, determination is made as to whether or not there is an excluded color present, namely determination is made as to whether or not a there is a color whose nozzle-check patterns 92 is not to be overlapped. When such a color is present the routine proceeds to step 204. At step 204 determination is made as to whether or not the excluded color is black (K). The determination is affirmative when it is black (K) and the routine proceeds to step 206.

At step 206, the nozzle-check pattern 92K is printed separately and the other color (Y, M, C) nozzle-check patterns 92Y, 92M, 92C are printed in the non-image region 91 of the recording medium P so as to overlap with each other, and the routine proceeds to step 216. In such cases the size (width W) of the non-image region 91 becomes smaller (narrower) than that shown in FIG. 7B, since the nozzle-check patterns 92Y, 92M, 92C are overlapped.

Figure 9B:
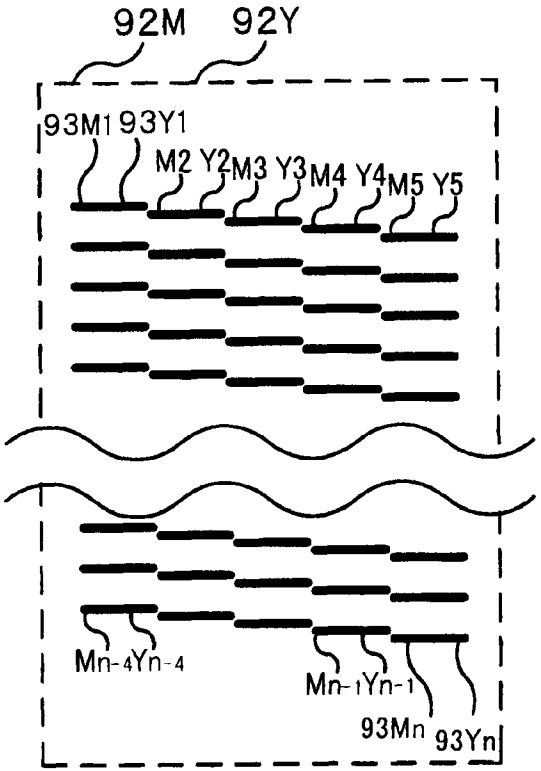
FIGS. 9A and 9B are explanatory diagrams for explaining a case in which a nozzle-check pattern M and a nozzle-check pattern Y are overlapped.
Figure 9A:
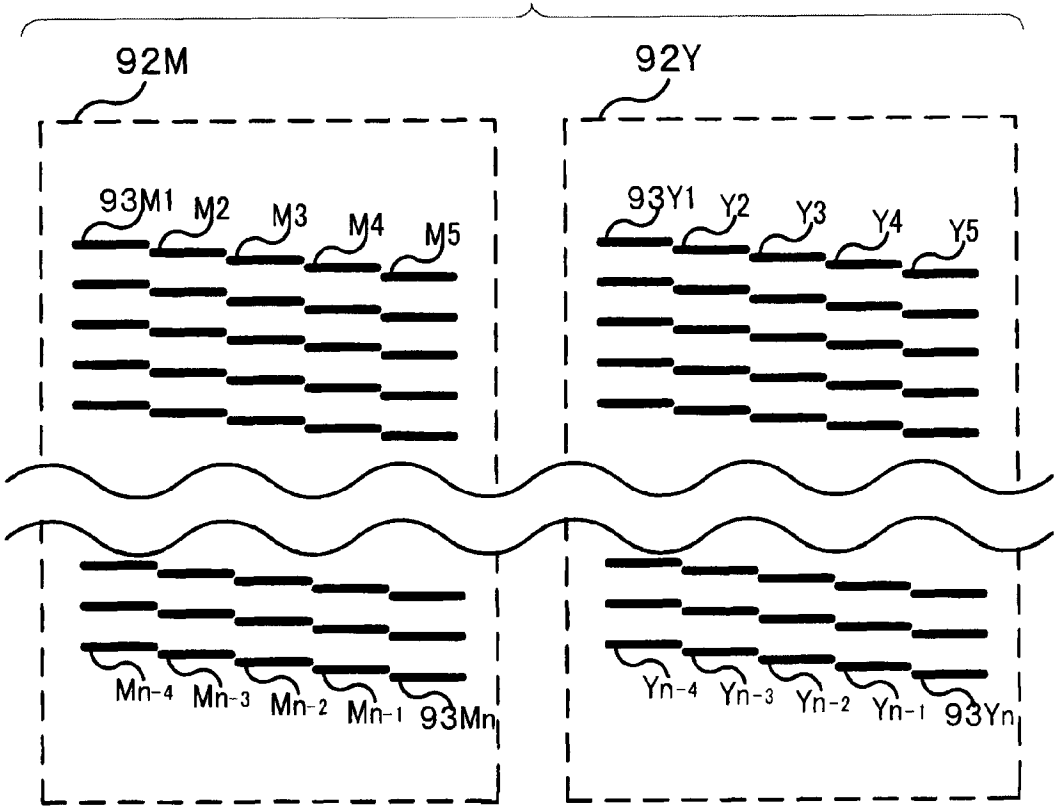

It should be noted that the nozzle-check pattern 92 with regard to the overlapping of the present invention, not all of (the entire image) of the nozzle-check patterns 92Y, 92M, 92C need be overlapping as long as a portion of the nozzle-check patterns 92Y, 92M, 92C overlaps. The degree of overlap may be determined from the read (spot) region and specification of the read sensor 46. FIG. 9A and FIG. 9B show a case in which the nozzle-check pattern 92M and the nozzle-check pattern 92Y are caused to overlap. FIG. 9B shows the case in which the lines 93M and the lines 93Y are overlapping.

If at step 204 the excluded color is not black (K), for example another color instructed by a user etc., a color with high frequency of use, or, when a spot color recording head 60 is provided, the spot color, then determination is negative and the routine proceeds to step 208. At step 208 the nozzle-check pattern 92 of the excluded color is printed separately and the other color nozzle-check patterns are printed in the non-image region 91 of the recording medium P so as to overlap with each other, and the routine proceeds to step 216. In such cases the size (width W) of the non-image region 91 becomes smaller (narrower) than that shown in FIG. 7B, since the nozzle-check patterns 92 for colors other than the excluded color(s) are overlapped.

When determination is made at step 202 that there are no excluded colors then the routine proceeds to step 210. At step 210 determination is made as to whether or not to overlap all of the colors (Y, M, C, K) together at once. When determined to overlap all of the colors (Y, M, C, K) together at once the routine proceeds to step 212.

At step 212 all of the nozzle-check patterns 92Y, 92M, 92C, 92K are overlapped and printed on the non-image region 91 of the recording medium P and the routine proceeds to step 216. In this case the size (width W) of the non-image region 91 becomes smaller (narrower) than that shown in FIG. 7B, since all the nozzle-check patterns 92Y, 92M, 92C, 92K are overlapped. The size (width W) of the non-image region 91 also becomes smaller (narrower) than in the case of step 206, the case of step 208, and a later described step 214.

When at step 210 determination is made that all of the colors are not to be overlapped together at once, then the routine proceeds to step 214. At step 214 the nozzle-check pattern 92K and the nozzle-check pattern 92C are overlapped, and the nozzle-check pattern 92M and the nozzle-check pattern 92Y are overlapped, these are printed in the non-image region 91 of the recording medium P, and the routine proceeds to step 216. The size (width W) of the non-image region 91 becomes smaller (narrower) than that shown in FIG. 7B, since nozzle-check pattern 92K and the nozzle-check pattern 92C are overlapped and the nozzle-check pattern 92M and the nozzle-check pattern 92Y are overlapped. The size (width W) of the non-image region 91 becomes smaller (narrower) than that shown in FIG. 7B, since the nozzle-check patterns 92 for colors other than the excluded color(s) are overlapped. The size (width W) of the non-image region 91 also becomes smaller (narrower) in comparison to the case of step 206 and the case of step 208.

It should be noted that preferably, as in step 214, that when overlapping pairs of nozzle-check patterns 92, combinations are made such that, when the colors (Y, M, C, K) are sequenced in brightness order K, M, C, Y, adjacent colors are not in sequence, since by doing so later described reading in with the read sensor 46 is facilitated, and a high detection precision is maintained. Therefore, in the present exemplary embodiment the nozzle-check pattern 92K and the nozzle-check pattern 92C are overlapped, and the nozzle-check pattern 92M and the nozzle-check pattern 92Y are overlapped, however there is no limitation thereto and other combinations may be made.

At step 216 determination is made as to whether or not to end the present processing. When the processing is not to be ended then the routine returns to step 200, and the present processing is repeated. However, when determination is to end image forming (e.g. all of the image data that has been instructed for forming has been printed) the present processing is ended.

It should be noted that in the above processing when there is an excluded color (affirmative step 202) then the nozzle-check patterns 92 of all of the colors (three colors) other than excluded color are overlapped and printed, however there is no limitation thereto and the nozzle-check patterns 92 of two colors may be overlapped, with the nozzle-check pattern 92 of one color printed separately. In such a case the nozzle-check patterns 92 of the two colors that are non adjacent colors, when the three colors other than the excluded color are sequenced in brightness order, are preferably overlapped and printed. For example when the excluded color is black (K), configuration may be made such that the nozzle-check pattern 92M and the nozzle-check pattern 92Y are overlapped, and the nozzle-check pattern 92C is printed separately.

As explained above, by the present processing the size (width W) of the non-image region 91 becomes smaller (narrower) than that shown in FIG. 7B, since the nozzle-check patterns 92 are printed overlapped.

Printing of the nozzle-check patterns 92 is performed by the recording unit 50 in the above manner in response to a nozzle-check pattern print instruction of step 102 in the ejecting condition detection processing shown in FIG. 5.

At step 104, the next step after step 102, instruction is given to the read sensor 46 to read the nozzle-check patterns 92. In the present exemplary embodiment lines 93 corresponding to the respective n individual nozzles 64 are read in sequentially. There are no particular limitations to the read sensor 46 as long as it is capable of reading in the lines 93 of the nozzle-check patterns 92 for each of the nozzles, and a monochromatic sensor or a color sensor may be employed, such as for example an optical sensor. It should be noted that read-in results (sensor output values) are corresponded to the nozzles 64Y1 to 64Yn, 64M1 to 64Mn, 64C1 to 64Cn, 64K1 to 64Kn and stored in the HDD 78.

At the next step 106 ejecting condition detection is carried out for each of the nozzles 64. In the present exemplary embodiment detection is made for whether or not poor ejection is occurring.

Figures 10A, 10B:
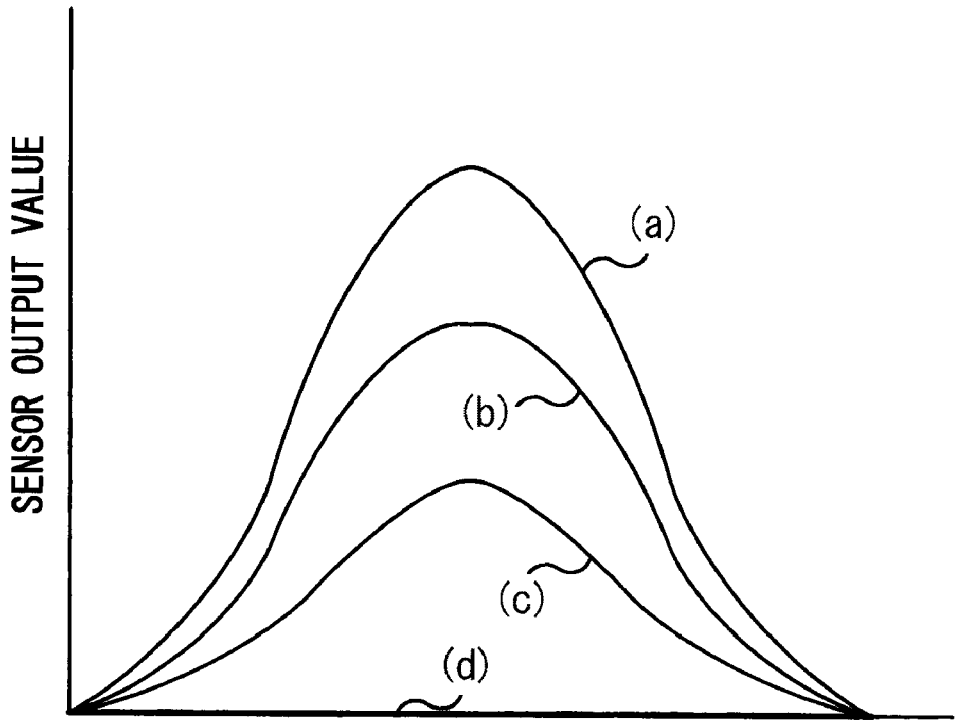
FIGS. 10A and 10B are explanatory diagrams for explaining the read-in results from reading in an overlapping print of nozzle-check pattern M and nozzle-check pattern Y with a monochromatic sensor.

Explanation will now be given of ejecting condition detection when the read sensor 46 is a monochromatic sensor 46, with reference to FIG. 10A and FIG. 10B. FIG. 10A and FIG. 10B show the read-in results from one nozzle's worth (for example nozzle 64M1 and nozzle 64Y1) of overlapped and printed nozzle-check pattern 92M and nozzle-check pattern 92Y, as read in by the monochromatic sensor 46. FIG. 10A shows the output values of the monochromatic sensor 46, and FIG. 10B show the ejecting conditions corresponding to the output values.

When the sensor output value is as shown in (a) this indicates that the nozzle-check pattern 92M (lines 93M) and the nozzle-check pattern 92Y (lines 93Y) are printing and there is normal operation (ejecting) for both the nozzles 64M and 64Y When the sensor output value is as shown in (b) this indicates that the nozzle-check pattern 92M is printing, but the nozzle-check pattern 92Y is not printing or thin spots are occurring, and there is normal ejecting for the nozzle 64M but poor ejecting is occurring in nozzle 64Y When the sensor output value is as shown in (c) this indicates that the nozzle-check pattern 92M is not printing or thin spots are occurring, and the nozzle-check pattern 92Y is printing, and poor ejecting is occurring in the nozzle 64M but there is normal ejecting for nozzle 64Y. When the sensor output value is as shown in (d) with substantially no output value this indicates that both the nozzle-check pattern 92M and the nozzle-check pattern 92Y are not printing or thin spots are occurring, and poor ejecting is occurring in both the nozzles 64M and 64Y.

In this manner, since the brightness of each of the colors of lines 93 are different the sensor output values are also different, and detection of the ejecting condition of each of the nozzles is possible from the different output values of the monochromatic sensor 46.

Figure 11:
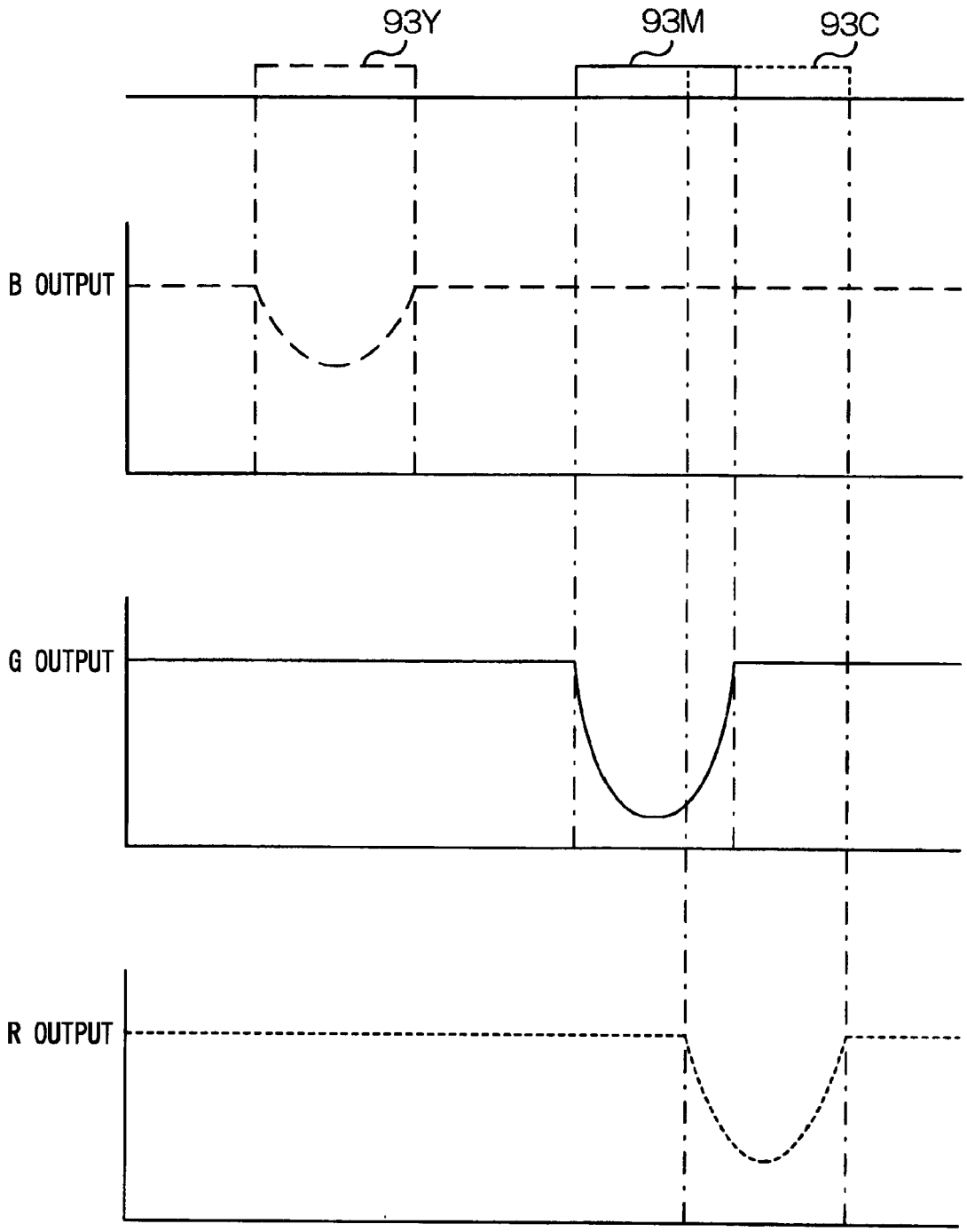
FIG. 11 is an explanatory diagram for explaining the read-in result from reading in an overlapping print of nozzle-check pattern C, nozzle-check pattern M, and nozzle-check pattern Y with a color sensor.

Explanation will now be given regarding the ejecting condition detection when the read sensor 46 is a color sensor 46, with reference to FIG. 11. FIG. 11 shows the read-in results for one nozzle's worth (for example nozzle 64C1, nozzle 64M1 and nozzle 64Y1) of overlapped and printed nozzle-check pattern 92C, nozzle-check pattern 92M and nozzle-check pattern 92Y, as read in by the color sensor 46. The lines 93Y only absorb light of a B component wavelength, and reflect light of the R and G component wavelengths. The lines 93M only absorb light of a G component wavelength, and reflect light of the B and R component wavelengths. The lines 93C only absorb light of a R component wavelength, and reflect light of the R and B component wavelengths. Therefore the presence of absence of lines 93Y, 93M, 93C is detectable from the respective B, G, R output values of the color sensor 46.

In this manner since the wavelengths (B, G, R) of light absorbed are different for each of the lines 93 the sensor output values are different, and detection of the ejecting condition of each of the nozzles is possible from the different output values from the color sensor 46.

It should be noted that for the color sensor 46 plural sensors using different spectral sensitivity color filters may be used, or different spectral characteristic light sources may be used with a single color sensor.

At the next step 108 determination is made as to whether or not the ejecting condition is good (OK). This determination is negative even when there is only a single nozzle 64 with poor ejecting, and the routine proceeds to step 110. At step 110 the nozzle(s) 64 with poor ejecting are preliminarily stored on the HDD 78 with the recording unit control unit 70, and the routine proceeds to step 112 where non-ejection correction is performed. The non-ejection correction may be carried out, for example, by image processing.

In the next step 114 determination is made as to whether or not the number of individual nozzles 64 in which poor ejecting is occurring is a specific value or above. The specific value is a value determined in advance, such as the number of poor ejecting nozzles at which poor image quality occurs when forming images even with non-ejection correction by image processing etc. at step 112. When determination is made that the number of nozzles 64 is less than the specific value the routine proceeds to step 118. However, when there are more than the specific value the routine proceeds to step 116, and the routine proceeds to step 118 after instructing the recording head driving unit 80 to carry out maintenance at step 116. Specific examples of maintenance include reparatory actions such as suctioning or wiping the bad nozzles 64, however there is no limitation thereto.

However, when all of the nozzles 64 (64Y1 to 64Yn, 64M1 to 64Mn, 64C1 to 64Cn, 64K1 to 64Kn) are determined to be ejecting normally at step 108, the routine proceeds to step 118.

At step 118 determination is made as to whether or not to end the present processing. When determination is not to end the present processing the routine returns to step 100, and the present processing is repeated. However, when determination is to end image forming (e.g. all of the image data that has been instructed for forming has been printed) the present processing is ended.

It should be noted that while an example has been given in the image forming apparatus 10 of the present exemplary embodiment where four colors Y, M, C, K of ink are employed as the coloring material for forming images there is no limitation thereto, four colors are not required, and other colors may be employed, and the coloring material is not limited to ink. The configuration of the image forming apparatus is also not limited to that of the present exemplary embodiment and dot printers, thermal printers etc. may also be employed.

Explanation has also been given in the present exemplary embodiment of a case where the recording heads 60 have an effective printing region at least as long as the width (the length in a direction orthogonal to the conveying direction) of the recording medium P, however there is also no limitation thereto, and those with a shorter length than the width of the recording medium P may also be employed. In such cases since the non-image region 91 for printing the nozzle-check patterns 92 can also be made smaller, sufficient region may be secured for printing other test patterns, such as for carrying out registration or density correction.

Also in the present exemplary embodiment explanation has been given of a case where continuous paper is employed as the recording medium P, however there is no limitation thereto and cut-paper may also be employed. In such cases too, since the non-image region 91 for printing the nozzle-check patterns 92 can also be made smaller, printing of the nozzle-check patterns 92 within the pre-designated margins is facilitated.

By the present processing the nozzle-check patterns 92Y, 92M, 92C, 92K can be printed so as to overlap, the nozzle-check patterns 92Y, 92M, 92C, 92K read by the read sensor 46 for each of the nozzles 64Y1 to 64Yn, 64M1 to 64Mn, 64C1 to 64Cn, 64K1 to 64Kn, and the ejecting condition detected and processing carried out according to the ejecting condition (good-bad condition).

Second Exemplary Embodiment

Figure 14:
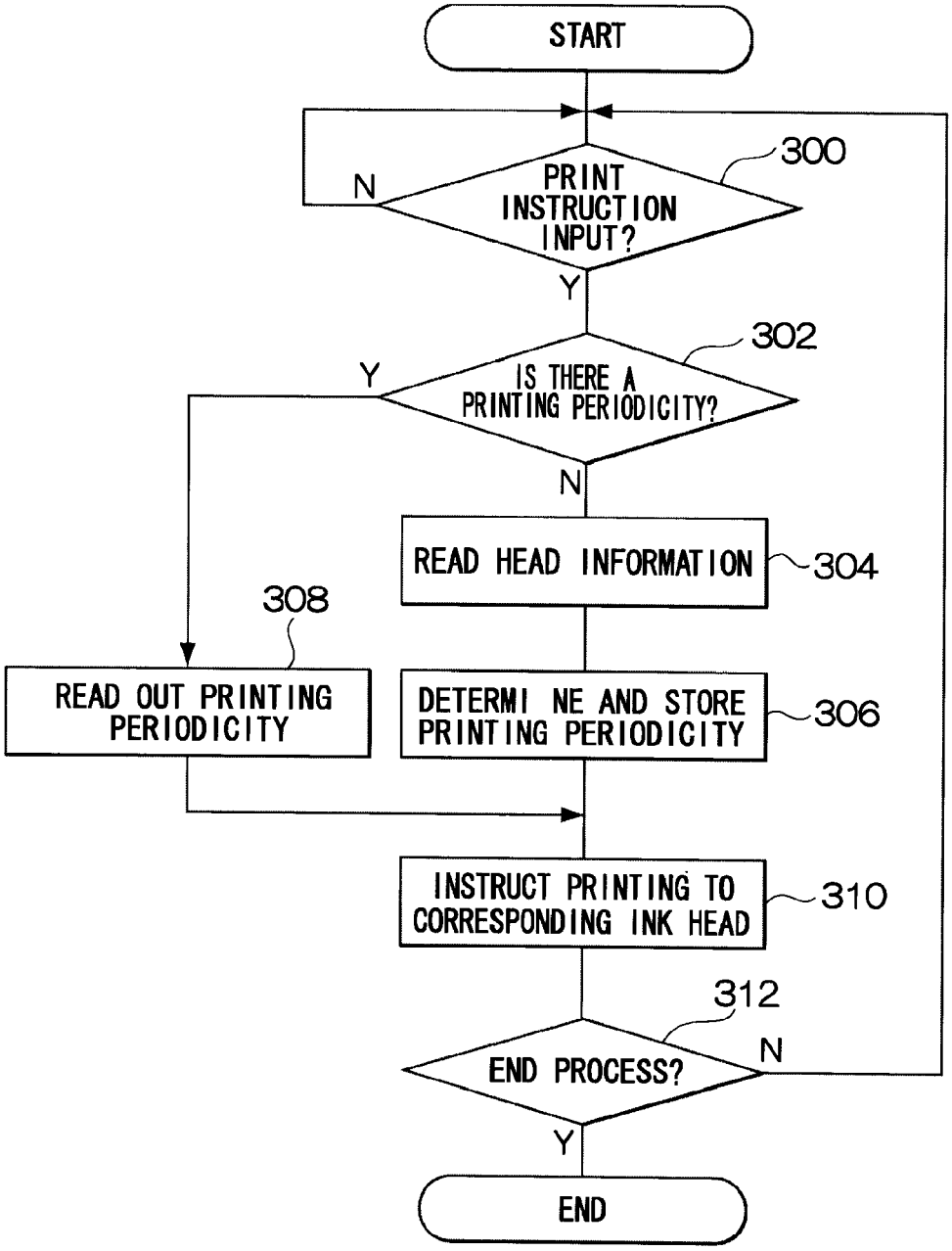
FIG. 14 is a flow chart showing an example of a control routine for nozzle-check pattern print processing executed in a recording unit control unit of a recording unit in the second exemplary embodiment.

Explanation will now be given of details of the second exemplary embodiment of the present invention, with reference to FIG. 12 to FIG. 14. The present exemplary embodiment is an image forming apparatus for forming images with a recording unit ejecting ink as a coloring material from nozzles onto a recording medium, and suppressing the frequency of printing detection images. It should be noted that portions of the present exemplary embodiment substantially the same as those of the first exemplary embodiment configuration are allocated the same reference numerals and explanation thereof is omitted.

Apart from a recording unit 51 the schematic configuration of the image forming apparatus of the present exemplary embodiment is configured substantially the same as that of the image forming apparatus 10 of the first exemplary embodiment, therefore detailed explanation thereof will be omitted.

Figure 12:
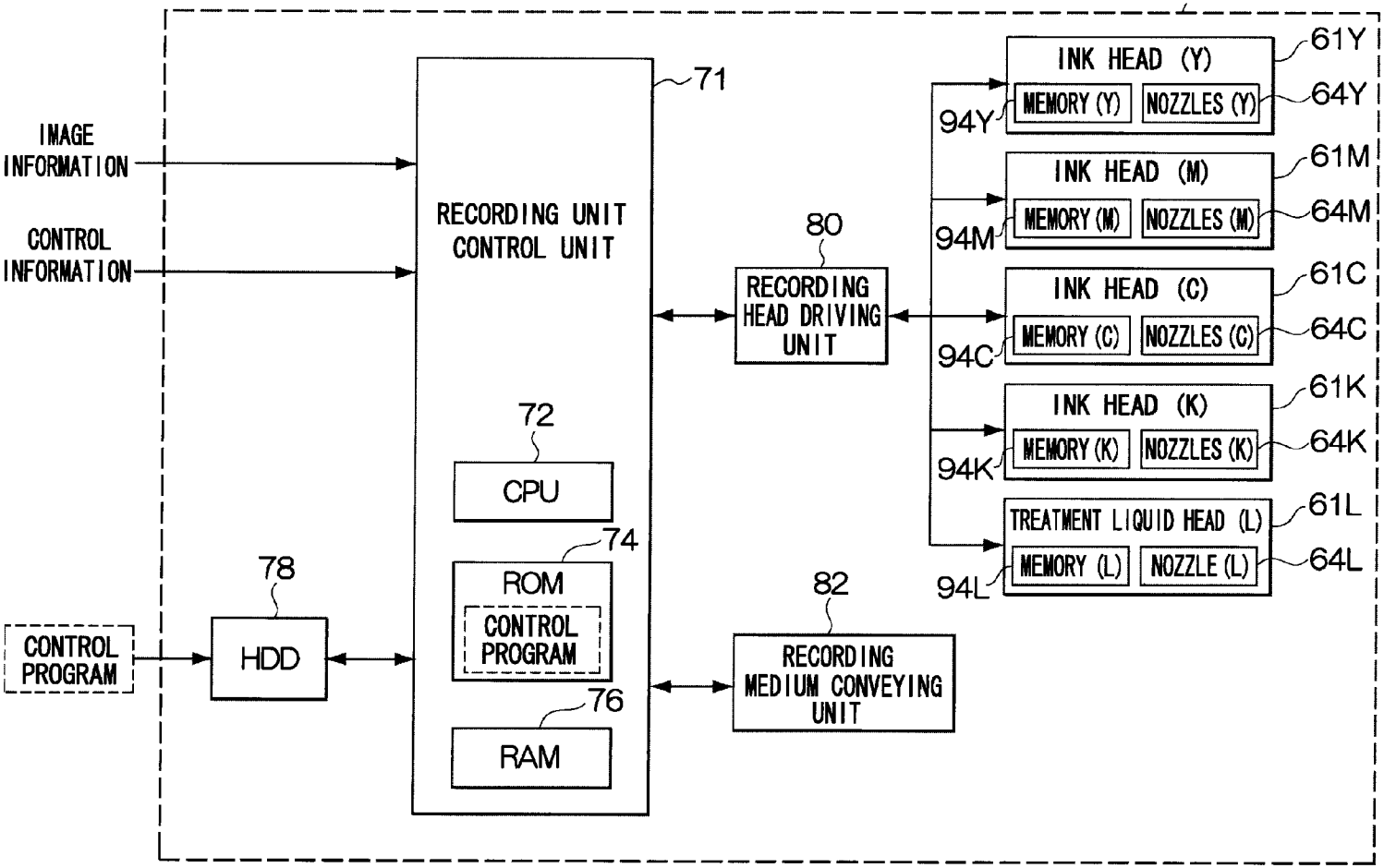
FIG. 12 is a functional block diagram for showing an example of a schematic configuration of a second exemplary embodiment.

A functional block diagram of an example of the schematic configuration of the recording unit 51 of the present exemplary embodiment is shown in FIG. 12. The recording heads 61 in the present exemplary embodiment are provided with memories 94 (memories 94Y, 94M, 94C, 94K, 94L), one for each of the heads. Head information for each of the recording heads 61 is stored in advance in the memories 94. The head information in the present exemplary embodiment is, for example, information representing the grade of ejecting condition of the nozzles 64, detected in advance at the manufacturing stage of the recording heads 61, grading of the ejecting condition of the nozzles 64 being the allocation of two grades (grade 1 and grade 2) and stored as 1-bit of information representing grade 1 or grade 2 in the memories 94. The recording heads 61 with the better grade have a stable ejecting performance, with a small chance that poor ejecting will develop even during printing for a prolonged period of time.

Explanation will now be given of a specific example of head information of the present exemplary embodiment. In this case grade information is based on the variation in the ejection directionability of the recording heads 61 (ejection position precision) with the grades split by the standard deviation σ from the optimal ejection position for each of the nozzles 64. For example head information is allocated as grade 1 or grade 2 for each of the heads as shown in FIG. 13A. In this case grade 1 is more precise than grade 2.

Explanation will now be given of another specific example of head information in the present exemplary embodiment. The recording unit 51 of the present exemplary embodiment is configured with exchangeable recording heads 61, and when a recording head 61 is exchanged for one with a different resolution, head information is allocated for each resolution. For example head information is allocated as shown in FIG. 13B. In this case when a high resolution recording head 61 is fitted the frequency of printing the nozzle-check pattern for the high resolution recording head 61 is set more often than the frequency for printing the nozzle-check pattern for a low resolution recording head 61.

In the present exemplary embodiment similar nozzle-check patterns to that of the first exemplary embodiment may be employed, for example the nozzle-check patterns 92 shown in FIG. 8A may be employed.

The head information is also not limited to these examples and grading may be carried out on the average value of the droplet amounts ejected from the nozzles 64 to give droplet amount grade information and this employed as the head information, and cumulative use duration information since fitting the recording head 61 may also be used.

Explanation will now be given of details of the nozzle-check pattern (detection image) print processing executed in a recording unit control unit 71 of the recording unit 51 of the present exemplary embodiment. The ejecting condition detection processing executed in the control unit 30 of the image forming apparatus of the present exemplary embodiment is substantially that of the ejecting condition detection processing of the first exemplary embodiment (shown in the flow chart of FIG. 5) and so explanation here will be omitted.

Explanation will now be given of details of an example of a control routine for nozzle-check pattern print processing, with reference to FIG. 14. FIG. 14 is a flow chart showing an example of a control routine of nozzle-check pattern print processing executed in the recording unit control unit 71 of the recording unit 51. The nozzle-check pattern print processing shown in FIG. 14 is, for example, executed such as when an instruction has been input to the recording unit control unit 71 by the control unit 30 when carrying out image forming or the like.

First at step 300 determination is made as to whether or not an instruction to print the nozzle-check patterns 92 has been input. When determination is negative then a standby state is adopted until a print instruction is entered from the control unit 30. In the present exemplary embodiment the timing with which the print instruction is input from the control unit 30 of the image forming apparatus to the recording unit control unit 71 is a timing so as to print the nozzle-check patterns 92 during an image formation run (or an even more specific example is between pages of image forming).

However, when determination is made that no print instruction has been input the routine proceeds to step 302. At step 302 determination is made as to whether or not a printing periodicity (detailed later) for printing the nozzle-check patterns 92 has been pre-stored on the HDD 78 by the recording unit control unit 71. When it is determined that the printing periodicity is stored the routine proceeds to step 308, and after the printing periodicity pre-stored on the HDD 78 by the recording unit control unit 71 at step 308 the routine proceeds to step 310.

However, when determined that the printing periodicity is not stored the routine proceeds to step 304. At step 304 the head information is read out from respective memories of the memories 94Y, 94M, 94C, 94K of the ink heads 61Y, 61M, 61C, 61K.

At the next step 306, the printing periodicity is determined for the nozzle-check patterns 92 based on the head information that has been read out, and the determined printing periodicity is stored on the HDD 78. Explanation will now be given of details regarding one specific example of the printing periodicity. For example if the ink head 61Y is grade 1, the ink head 61M is grade 2, the ink head 61C is grade 2, and the ink head 61K is grade 1 then information indicating the grade is stored as head information in the respective memories 94Y, 94M, 94C, 94K and configuration of the printing periodicity is made such that the printing frequency of the grade 1 ink head 61Y and ink head 61K is less frequent that the printing frequency of the grade 2 ink head 61M and ink head 61C. An example is a cycle of "K, C, M, Y, C, M", however there is no limitation thereto as long as the printing frequency of the grade 1 ink head(s) 61 is less than the printing frequency of the grade 2 ink head(s) 61.

In the next step 310 printing is instructed for the nozzle-check pattern(s) 92 for the corresponding recording head(s) 61 based on the printing periodicity stored in the HDD 78. It should be noted that in the present exemplary embodiment, which of the nozzle-check patterns printed corresponds to which printing periodicity, or which nozzle-check pattern to print next time corresponds to which printing periodicity, is stored on the HDD 78 along with the printing periodicities. Namely when it is the first time one of the nozzle-check patterns 92 is to be printed the nozzle-check pattern 92K is printed, and the nozzle-check pattern 92C is printed in response to the next print instruction, with the nozzle-check pattern 92M printed in response to the subsequent print instruction. In the present exemplary embodiment a nozzle-check pattern 92 corresponding to a single ink head 61 is printed for each print instruction in this manner.

At the next step 312 determination is made as to whether or not to end the present processing. When determination is not to end the present processing the routine returns to step 300, and the present processing is repeated. However, when determination is to end image forming (e.g. all of the image data that has been instructed for forming has been printed) the present processing is ended.

According to the present processing, as explained above, a reduction (less often) in the non-image region 91 for printing the nozzle-check patterns 92 is enabled, since the frequency of printing the nozzle-check patterns 92 for the grade 1 ink heads 61 is made less frequent than that of the grade 2 ink heads 61.

It should be noted that the recording heads 61 in the present exemplary embodiment are configured in a similar manner to those of the first exemplary embodiment shown in FIG. 2A, 2B or 2C, however when the recording heads 61 are configured to include plural modules 66 as shown in FIG. 2C, then a grade is allocated to each of the modules 66, and the printing periodicity thereof may be determined based on the corresponding grades. Explanation will now be given of details of a specific example of printing periodicity in such cases. For example, if a module 66Y1 and a module 66Y2 of the ink head 61Y are both grade 1, a module 66M1 of the ink head 61M is grade 2 and a module 66M2 thereof is grade 1, a module 66C1 of the ink head 61C is grade 2 and a module 66C2 thereof is grade 1, a module 66K1 of the ink head 61K is grade 1 and a module 66K2 thereof is grade 1, then information indicating these grades is stored in each of the respective memories 94Y, 94M, 94C, 94K. Configuration of the printing periodicity is made such that the printing frequency of the grade 1 modules 66, that is module 66Y1, module 66Y2, module 66M2, module 66C2, module 66K1, and module 66K2, is less frequent than the printing frequency of the grade 2 modules, that is module 66M1, and module 66C1. An example is a cycle of "K1, C1, M1, Y1, C1, M1, K2, C2, M2, Y2", however there is no limitation thereto as long as the printing frequency of the grade 1 modules 66 is less than the printing frequency of the grade 2 modules 66.

The grading may also be allocated for each of the nozzles 64, and the printing periodicity determined based on these grades.

It should be noted that in the present exemplary embodiment the nozzle-check patterns 92 corresponding to the ink heads 61 are printed with printing performed once for each of the input print instructions, however there is no limitation thereto and nozzle-check patterns 92 corresponding to plural ink heads 61 may be printed (printing nozzle-check patterns 92 for plural colors in a single non-image region 91). In such cases, the frequencies of printing the nozzle-check patterns 92 for the grade 1 ink heads 61 may be set so as to be less than that of the grade 2 ink heads 61 in the nozzle-check pattern print processing when taken as a whole. In addition, in such cases the non-image region 91 becomes less by overlapping and printing nozzle-check patterns 92 as in the first exemplary embodiment.

The head information stored in the memories 94 may be configured so as to be occasionally rewritten, such as based on the duration of used of the corresponding recording head 61 and based on the results of the ejecting condition detection of the nozzles 64 (the results of the ejecting condition detection of step 106 shown in FIG. 5). The precision of ejecting condition detection is increased by rewriting the grade information according to the condition of the recording heads 61.

In addition in the present exemplary embodiment the head information is stored on the memory 94 provided to each of the recording heads 61, however the head information may be linked to the head ID of the recording head 61 and stored in the HDD 78 etc., or the head information may be input by a user or external computer (not shown in the figures) through the image forming instruction input-output unit 40 and the recording head 60.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image recording elements that record with a plurality of coloring materials on a recording medium and form an image, at least one of the plurality of image recording elements provided for each of the coloring materials, the coloring materials comprising a black color coloring material, a cyan color coloring material, a magenta color coloring material, and a yellow color coloring material;

a control unit that controls the plurality of image recording elements such that detection images of two coloring materials having different brightness of the plurality of coloring materials overlap each other on the recording medium, and the control unit controls such that the detection image of the black color coloring material and the detection image of the cyan color coloring material overlap each other, and the detection image of the magenta color coloring material and the detection image of the yellow color coloring material overlap each other;

a monochromatic sensor that reads a portion of the detection images in which said two coloring materials overlap each other; and a detection unit that detects whether or not each of the respective image recording elements that record said two coloring materials are functioning normally based on an output value corresponding to brightness of the monochromatic sensor when the monochromatic sensor reads the portion of the detection images in which said two coloring materials overlap each other.

2. The coloring material recording device according to claim 1, wherein the control unit sets the detection images of non-adjacent coloring materials in a brightness sequence, of the plurality of coloring materials placed in sequence of brightness, so as to overlap each other.

3. The coloring material recording device according to claim 1, wherein the control unit controls such that the detection image of a predetermined coloring material does not overlap with the detection image of the other coloring material.

4. The coloring material recording device according to claim 3, wherein the predetermined coloring material is a black color coloring material.

5. The image forming apparatus according to claim 1, wherein the plurality of image recording elements are nozzles disposed on an inkjet head that ejects inks that include the plurality of coloring materials.

6. A computer readable medium storing a program causing a computer to execute a process for recording with a plurality of coloring materials on a recording medium and forming an image, the coloring materials comprising a black color coloring material, a cyan color coloring material, a magenta color coloring material, and a yellow color coloring material, the process comprising:

controlling a plurality of image recording elements provided one for each of the coloring materials such that detection images of two coloring materials having different brightness of the plurality of coloring materials overlap each other on the recording medium, the detection image of the black color coloring material and the detection image of the cyan color coloring material overlapping each other, and the detection image of the magenta color coloring material and the detection image of the yellow color coloring material overlapping each other;

reading, with a monochromatic sensor, a portion of the detection images in which said two coloring materials overlap each other; and detecting whether or not each of the respective image recording elements that record said two coloring materials are functioning normally based on an output value corresponding to brightness of the monochromatic sensor when the monochromatic sensor reads the portion of the detection images in which said two coloring materials overlap each other.

* * * * *